US005540829A

United States Patent [19]

Mase et al.

[11] Patent Number: 5,540,829

[45] Date of Patent: Jul. 30, 1996

[54] COMPOSITE PLATING METHOD FOR HOLLOW MEMBER

[75] Inventors: Hiroaki Mase; Osamu Ishigami; Hitoshi Karasawa, all of Saitama, Japan

[73] Assignee: Honda Giken Kogyo Kabushiki Kaisha, Tokyo, Japan

[21] Appl. No.: 364,237

[22] Filed: Dec. 27, 1994

[30] Foreign Application Priority Data

Dec. 27, 1993 [JP] Japan ..... 5-348606
Dec. 27, 1993 [JP] Japan ..... 5-348612

[51] Int. Cl.[6] ..... C25D 15/00

[52] U.S. Cl. ..... 205/109; 205/131

[58] Field of Search ..... 205/96, 109, 131

[56] References Cited

U.S. PATENT DOCUMENTS 4,085,010 4/1978 Ishimori ..... 205/109
5,266,181 11/1993 Matsumura ..... 205/109

FOREIGN PATENT DOCUMENTS 1200410 7/1970 United Kingdom ..... 205/109

*Primary Examiner*—John Niebling
*Assistant Examiner*—Brendan Mee
*Attorney, Agent, or Firm*—Merchant, Gould, Smith, Edell, Welter & Schmidt

[57] ABSTRACT

In a disclosed composite plating method for a hollow member, an insertion electrode is loosely inserted with a space into a cylinder of a hollow member, a composite plating solution supplied from a solution supply pipe is circulated into the space of the cylinder, a base metal electrode is connected to the hollow member and composite plating is applied onto the inner peripheral surface of the hollow member. The current density between the insertion electrode and the inner peripheral surface of the hollow member is set at a low value at the beginning and is increased after a lapse of a predetermined time. More preferably, bubbles are produced by supplying gas into the composite plating solution almost simultaneously with the above-mentioned increase of the current density.

7 Claims, 6 Drawing Sheets

COMPOSITE PLATING METHOD FOR HOLLOW MEMBER

BACKGROUND OF THE INVENTION

1. Field of the Invention

The present invention relates to a method of obtaining composite plating with good adhesion when the composite plating is applied to the surface of various kinds of members, in particular, the cylindrical inner surface of a hollow member by circulating a composite plating solution in a cylinder perforated in the hollow member.

2. Description of the Related Art

Conventionally, for example, the wear resistance of the inner surface of a cylinder in an engine of an automobile is increased by circulating a composite plating solution, consisting of a nickel sulfate solution with Silicon carbide fine particles suspended therein, in the cylinder and bringing about eutectoid of nickel and silicon carbide on the inner surface of the cylinder.

In such a method, the eutectoid of nickel and silicon carbide is typically induced on the inner surface of the hollow member by inserting an electrode inside the cylinder so as to be spaced from the cylinder wall, connecting the cylinder to a base metal electrode, and butting a composite plating solution into the space inside the cylinder.

The eutectoid in such composite plating appears on the inner surface in a state in which silicon carbide fine particles are wrapped in a nickel matrix as a metal phase. However, there is a problem in that adhesion to a base metal is lowered when the eutectoid amount of the silicon carbide fine particles is large from the beginning of the plating process.

SUMMARY OF THE INVENTION

It is an object of the present invention to provide a composite plating method for a hollow member comprising the steps of loosely inserting an insertion electrode inside a cylinder of a hollow member so as to be spaced from the cylinder wall, circulating a composite plating solution supplied from a solution supply pipe in the space of the cylinder, connecting a base metal electrode to the hollow member and applying composite plating onto the inner peripheral surface of the hollow member, wherein adhesion to a base metal is enhanced by mainly using nickel at the beginning of a plating process, and then, wear resistance is increased by inducing the eutectoid of many fine particles on the side of the surface of the plating layer.

According to an aspect of the present invention, there is provided a composite plating method for a hollow member comprising the steps of loosely inserting an insertion electrode into a cylinder of a hollow member so as to be spaced from the cylinder wall, circulating a composite plating solution supplied from a solution supply pipe into the space of the cylinder, connecting a base metal electrode to the hollow member and applying composite plating onto the inner peripheral surface of the hollow member, wherein the current density between the insertion electrode and the inner peripheral surface of the hollow member is set at a low value at the beginning and is increased after a lapse of a predetermined time. More preferably, bubbles are produced by supplying air into the composite plating solution almost simultaneously with the above-mentioned increase of the current density.

According to the above method, when the current density is lowered, the movement amount of nickel ions, which are deposited from the composite plating solution, per unit time is lowered and the plating speed is decreased. Therefore, the eutectoid amount of fine particles taken into the nickel ions is reduced, a thin plating layer mainly composed of a metal phase is formed on the surface of a base metal, and thereby, the adhesion is enhanced. The plating time is shortened by increasing the current density after a predetermined time has passed. When bubbles are mixed into the composite plating solution, fine particles are pushed toward the inner peripheral surface by the passage of the bubbles, and the eutectoid amount thereof is increased. Accordingly, a more efficient eutectoid effect of fine particles can be expected by supplying gas into the plating solution almost simultaneously with the increase of the current density to produce bubbles.

In the composite plating method for a hollow member according to the present invention, the above object also can be achieved by decreasing the flow velocity of the composite plating solution in the space when a predetermined time has passed from the start of inflow of the composite plating solution. In this case, it is also preferable to start the supply of gas for producing bubbles in the composite plating solution simultaneously with the above decrease of the flow velocity of the composite plating solution. Furthermore, it is preferable that the current density between the insertion electrode and the hollow member be increased almost simultaneously with the above decrease of the flow velocity of the composite plating solution.

It is revealed that, when composite plating is applied while circulating the composite plating solution, the eutectoid amount of fine particles tends to decrease as the flow velocity of the plating solution increases, and to increase as the flow velocity decreases. Therefore, a plating layer mainly composed of a metal phase is formed on the surface of the base metal by increasing the flow velocity at the beginning of inflow of the plating solution, and adhesion to the base metal is increased. The eutectoid amount of fine particles can be increased by reducing the flow velocity after a lapse of a predetermined time. In this case, when bubbles are mixed into the composite plating solution, since the fine particles are similarly pushed toward the inner peripheral surface by the passage of the bubbles and the eutectoid amount is increased, a more efficient eutectoid effect of fine particles can be expected by producing bubbles by supplying gas into the plating solution simultaneously with the decrease of the flow velocity. Furthermore, since the plating speed is increased by increasing the current density, the plating time is shortened by increasing the current density simultaneously with the decrease of the flow velocity.

DETAILED DESCRIPTION OF THE PREFERRED EMBODIMENTS

Preferred embodiments of a composite plating method for a hollow member according to the present invention will now be described with reference to the attached drawings.

Figure 1:
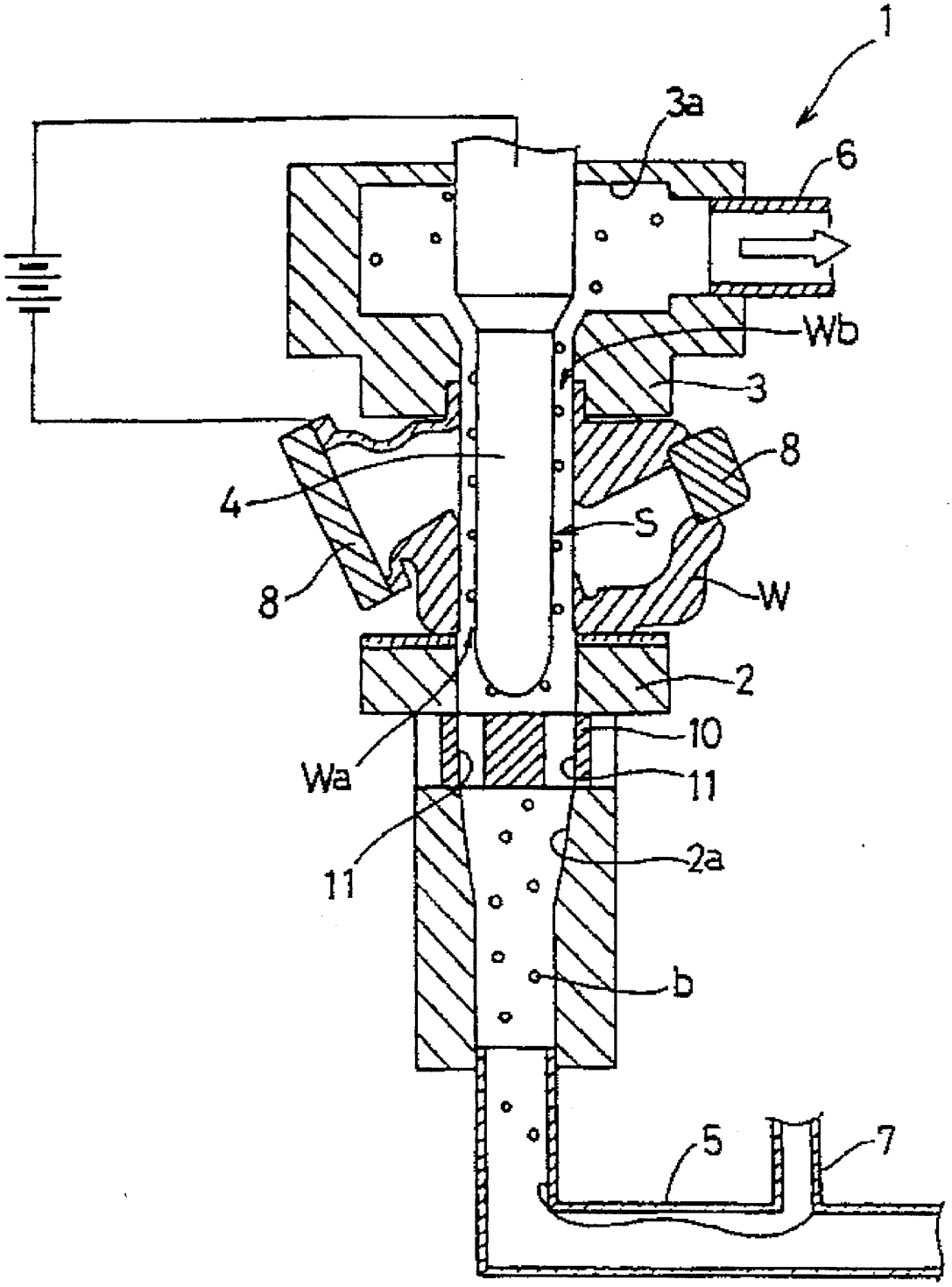
FIG. 1 is a longitudinal sectional view of a composite plating apparatus used in a composite plating method for a hollow member according to the present invention.

FIG. 1 is a longitudinal sectional view of a plating apparatus 1 used in the composite plating method for a hollow member according to the present invention. As shown in FIG. 1, the plating apparatus 1 comprises a presser jig 3 for pressing down the top of a cylinder block W defining at least one cylinder therein, an insertion electrode 4 loosely inserted in the cylinder from above with a space or clearance S between the cylinder and the insertion electrode 4, and a solution supply pipe 5 for putting a composite plating solution into the space S. Flow holes *2a* and *3a*, each capable of passing the plating solution therethrough, are respectively formed in a jig base 2 at the bottom and the presser jig 3 at the top, The flow hole *2a* of the lower jig base 2 is structured so as to connect the solution supply pipe 5 to a plating solution lead-in portion Wa of the cylinder, and the flow hole *3a* of the upper presser jig 3 is structured so as to connect a plating solution lead-out portion Wb of the cylinder to a return pipe 6. A composite plating solution tank, a force feed pump and the like, which are not shown, are mounted upstream of the solution supply pipe 5, and an air supply pipe 7 for supplying air into the composite plating solution is connected to the middle of the solution supply pipe 5. The air supplied by the air supply pipe 7 allows bubbles b to be formed in the composite plating solution.

The composite plating solution to be used is obtained by adding 400 g of nickel sulfate, 35 g of boric acid and 2.5 g of sodium saccharin to one liter of water. The hardness is adjusted, the PH value is set at 4, and 60 g of silicon carbide fine particles are suspended therein. Since a plurality of openings are formed on the cylinder block W, they are covered with seal members 8 and 8. Furthermore, the jig base 2 is provided with a bubble dispersion member 10 for uniformly dispersing the bubbles b, and flow holes 11 formed along the circumferential direction of the bubble dispersion member 10 are located below the space S.

In a composite plating method according to a first embodiment of the present invention, the composite plating solution is sent into the space S in the cylinder block W under pressure through the solution supply pipe 5, and current is made to flow between the insertion electrode a and the cylinder block W, by which composite plating is applied onto the inner surface of the cylinder. On the other hand, the composite plating solution which has flown out of the upper plating solution lead-out portion Wb is returned to the plating solution tank through the return pipe 6.

In the first embodiment, the deposition rate of nickel (Ni) is high at the beginning of the plating process, and the eutectoid amount of silicon carbide (SiC) is increased from the point when sufficient adhesion is obtained.

Adhesion is specifically enhanced by setting the current density in plating at a low value at first and changing it later in the first embodiment.

In other words, nickel (Ni), which has a valence of 2, a gram equivalent of 29.345, a specific gravity of 8.85 and an electro chemical equivalent of 0.3014 (mg/C), has an electrodeposition coefficient of 1A/dm$^2$ and a current deposition Mount of 0.206 (μ/min). When the cathode current efficiency is 100% and the apparent increase of the efficiency resulting from SiC eutectoid is neglected, FIG. 3 reveals that the plating speed (μ/min) shown in the vertical axis is reduced An a proportional basks by decreasing the current density (A/dm$^2$) shown in the horizontal axis and increased by increasing the current density (A/dm$^2$).

When the plating speed of nickel (Ni) decreases, the content of fine particles of silicon carbide (SiC), which are taken into nickel ions and brought into an eutectoid condition, decreases.

Figure 2:
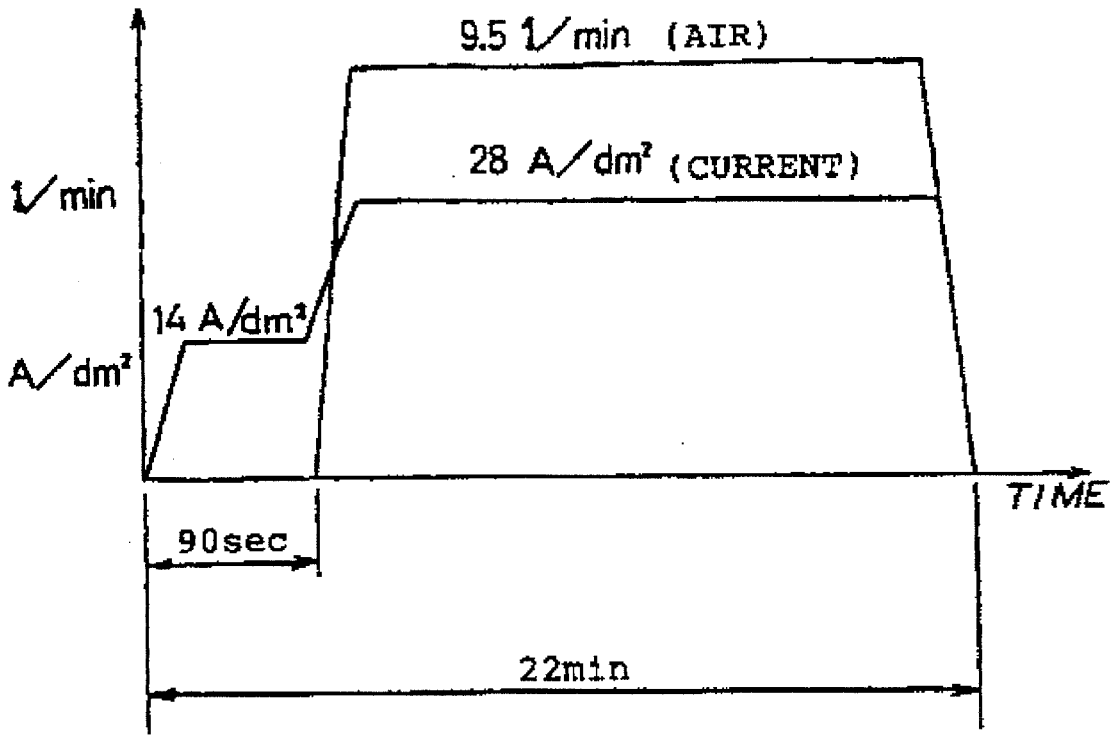
FIG. 2 is a graph showing the relationship between current density and the air supply control during a plating process in the composite plating method according to a first embodiment of the present invention.

Therefore, as shown in FIG. 2, the plating process is carried out at a current density of 14A/dm$^2$ for approximately one and a half minutes from the beginning of the process, and after that, the current density is raised to 28A/dm$^2$. A thin plating layer mainly composed of nickel (Ni) can be thereby formed on the inner peripheral surface of the cylinder and adhesion to the base metal can be enhanced. Furthermore, the plating time can be shortened by increasing the current density later in such manner.

The eutectoid amount of silicon carbide (SiC) when the current density is increased As approximately 2 wt % to 5 wt %.

In the first embodiment, the bubbles b are produced by supplying air into the plating solution from the air supply pipe 7 almost simultaneously with the increase of the current density in order to expedite the eutectoid of fine particles after the point when the current density is increased. The bubbles b produced in the plating solution move upward while pushing aside fine particles therearound. The fine particles pushed aside come closer to the cylinder inner surface, thereby enhancing the eutectoid effect.

It is noted that such an air supply into the plating solution is initiated after the passage of one and a half minutes from the beginning of the plating process and that the plating process is completed in approximately 22 minutes by the composite plating method according to the first embodiment.

As described above, since the current density is made low at the beginning and increased after a lapse of a predetermined time in the composite plating method of the first embodiment, it is possible to enhance adhesion to the base metal and to shorten the plating time. In addition, the eutectoid amount of fine particles can be increased without lowering the adhesion by mixing bubbles into the composite plating solution almost simultaneously with the increase of the current density.

A composite plating method for a hollow member according to a second embodiment of the present invention will now be described.

Figure 6:
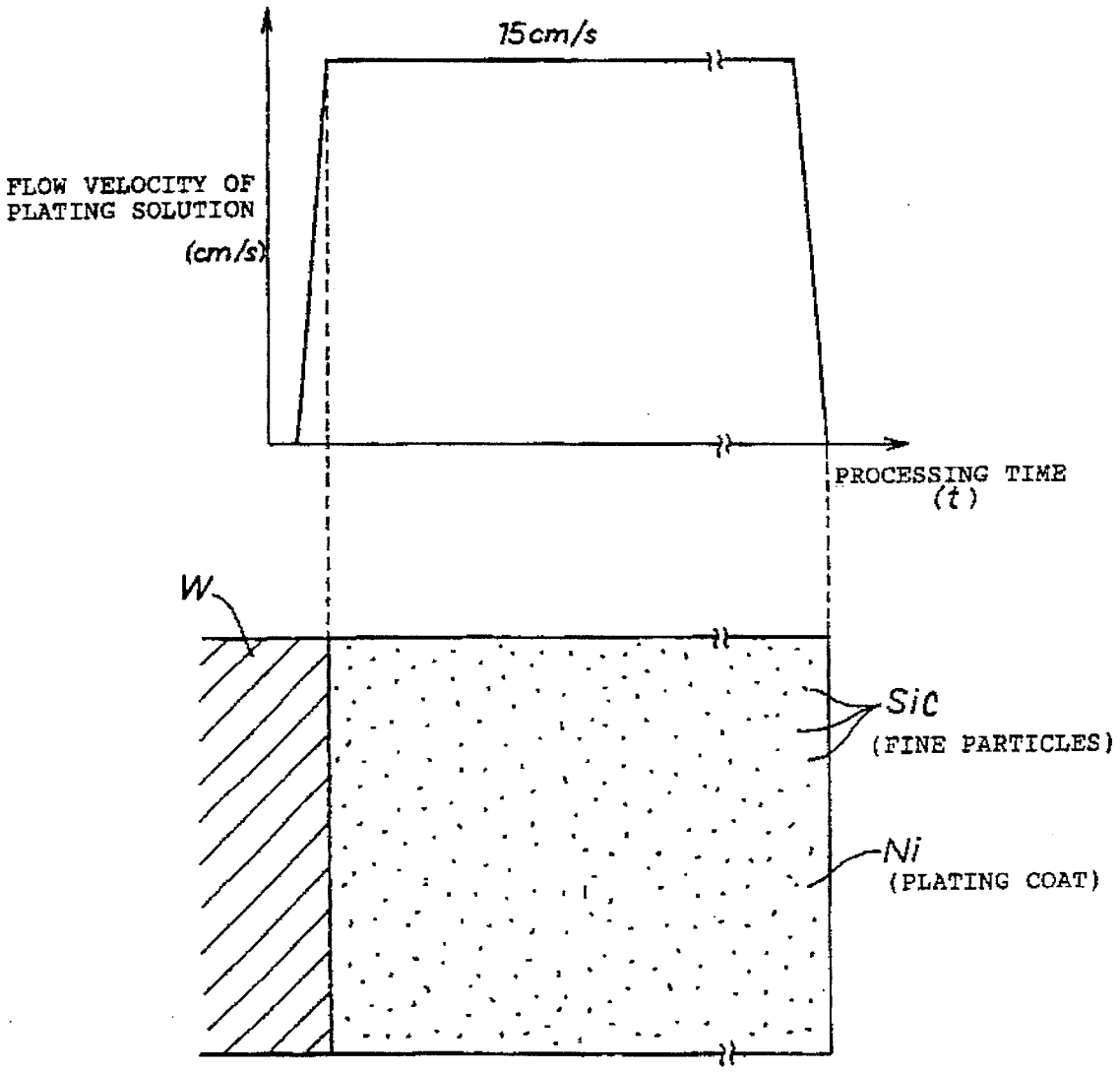
FIG. 6 is a graph showing the relationships between the flow velocity of the composite plating solution and the eutectoid of fine particles, and the plating time to be compared with FIG. 4 for reference.

If the flow velocity of the composite plating solution flowing through the space S is set at, for example, approximately 15 cm/s from the beginning of the plating process, the eutectoid amount of silicon carbide (SiC) in the plating layer is, as shown in FIG. 6, uniform, approximately 2 wt % to 5 wt % between an interface of the cylinder block W and the surface of the plating layer. In particular, since the eutectoid amount of fine particles is large on the side of the interface with the cylinder block, adhesion to the cylinder inner surface is lowered.

Therefore, in the second embodiment, the deposition rate of nickel (Ni) is also set at a high value at first, and the eutectoid amount of silicon carbide (SiC) is increased from the point when sufficient adhesion is obtained.

Adhesion is specifically enhanced by setting the flow velocity of the plating solution at a high value at the beginning of the plating process and decreasing it later.

Figure 4:
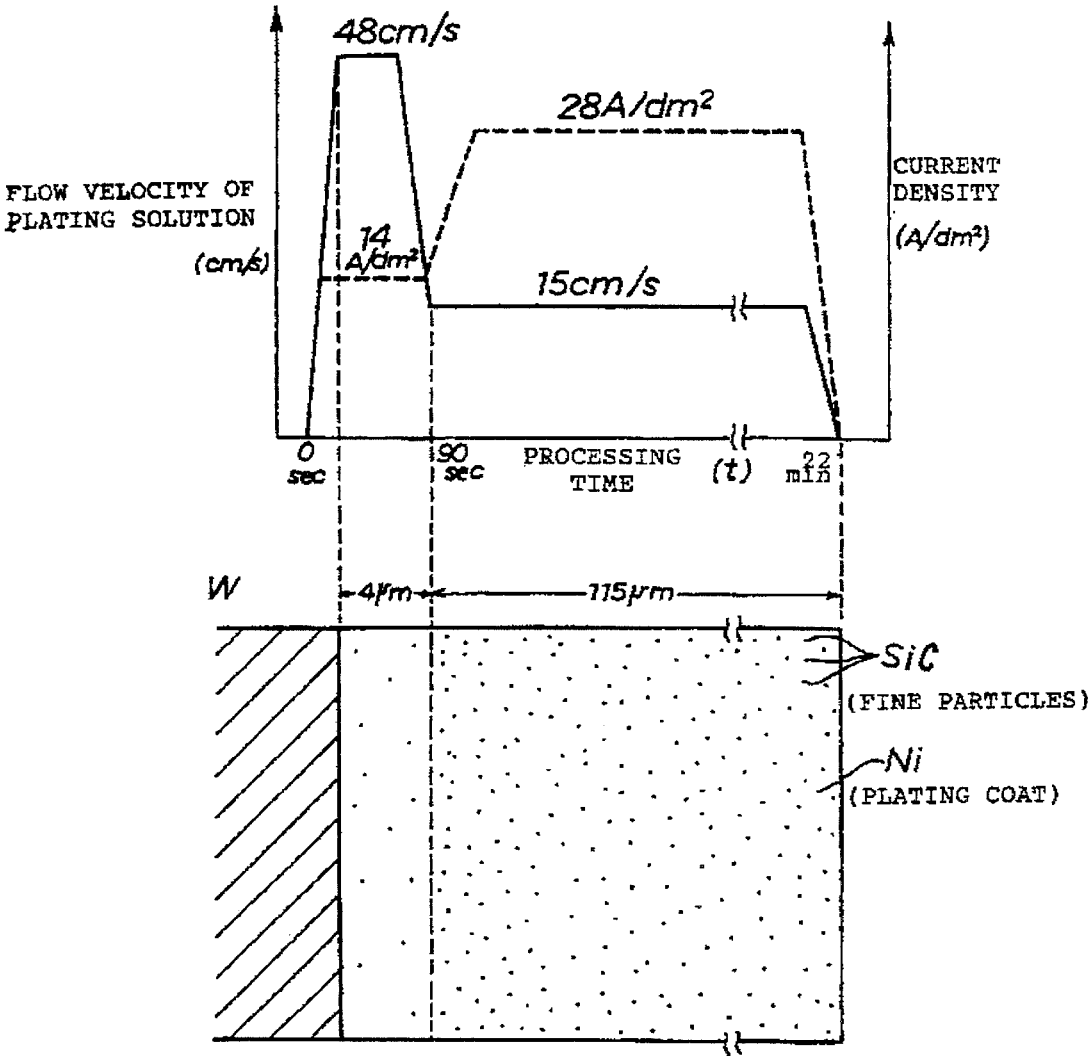
FIG. 4 is a graph showing the relationship between the flow velocity of a composite plating solution and the current density, and the plating time in a composite plating method according to a second embodiment of the present invention.
Figure 5:
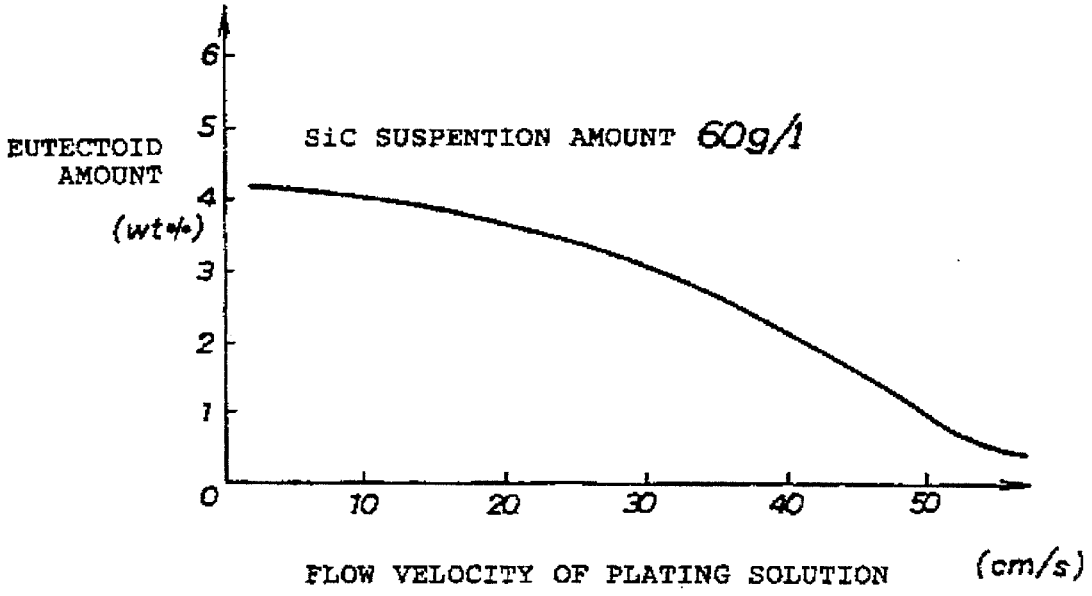
FIG. 5 is a graph showing the relationship between the flow velocity of the plating solution and the eutectoid amount of fine particles in the composite plating method according to the second embodiment.

In a general relationship between the eutectoid amount of fine particles and the flow velocity of the plating solution, as shown in FIG. 5, the eutectoid amount (wt %) of fine particles (SiC) (shown by the vertical axis) decreases as the flow velocity (cm/s) the plating solution (shown by the horizontal axis) increases when the suspension amount of the fine particles is constant (60 g/l). Through the use of this characteristic, in the second embodiment, the flow velocity of the plating solution is set at 48 cm/s for approximately 90 seconds from the beginning of the plating process and is lowered to approximately 15 cm/s later, as shown in FIG. 4.

Figure 3:
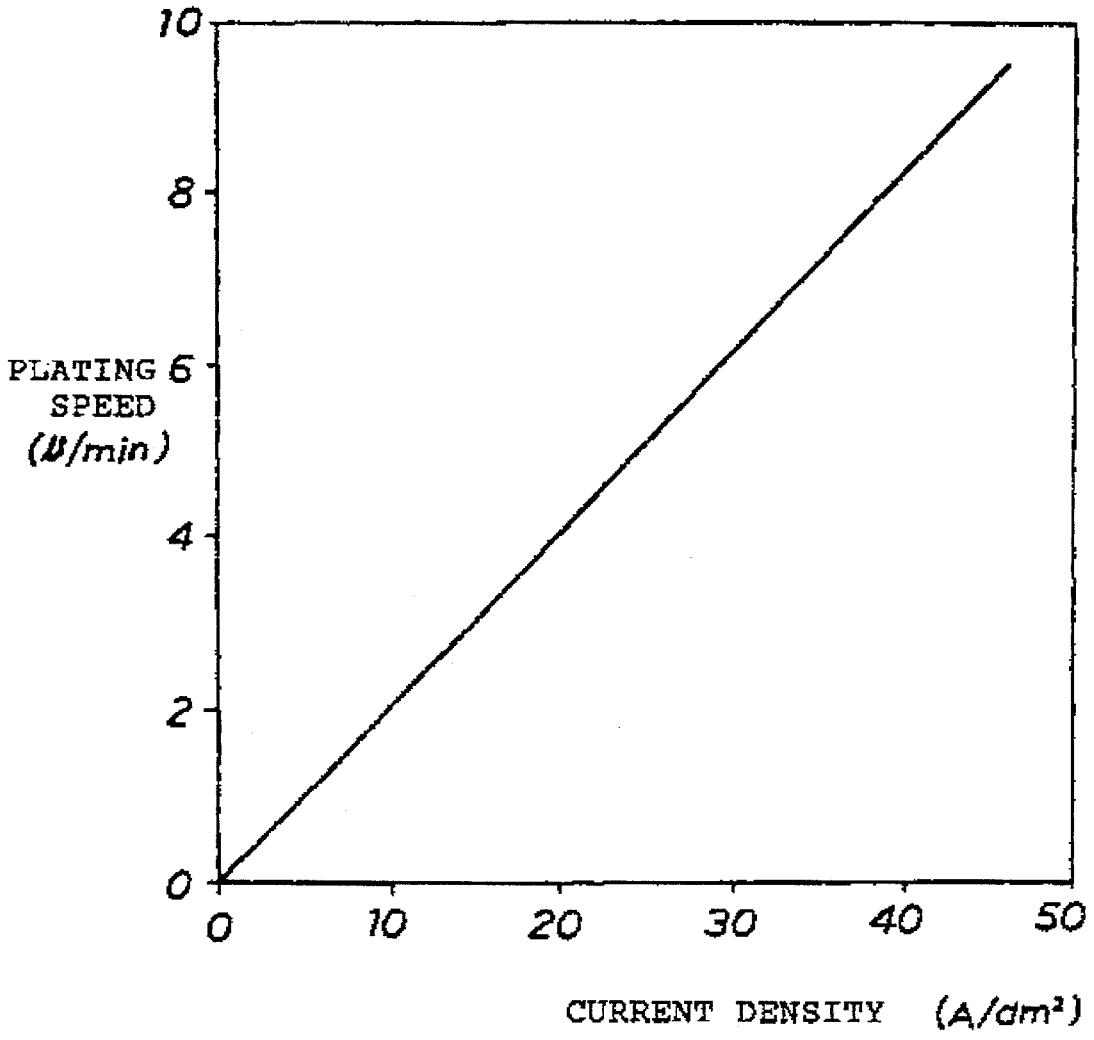
FIG. 3 is a graph showing the relationship between the current density and the plating speed in the above composite plating method.

As described in the above first embodiment with reference to FIG. 3, the plating speed (μ/min) is proportional to the current density ($A/dm^2$), that is, it is increased by increasing the current density. Therefore, in the second embodiment, the plating speed is increased by increasing the current density almost simultaneously with decreasing the flow velocity of the plating solution.

Adhesion to the base metal is enhanced in the second embodiment, and speedy plating can be achieved by such operation.

The result of experiments proves that the eutectoid amount of fine particles (SiC) is low in a plating layer of approximately 4 μm in thickness on the cylinder inner surface and that a plating layer of approximately 115 μm in thickness can be obtained in about 22 minutes in the same manner as in the above-mentioned first embodiment.

After the point when the flow velocity is lowered to approximately 15 cm/s, the eutectoid amount of fine particles is approximately 2 wt % to 5 wt %. This amount is sufficient for enhancing wear resistance.

In the second embodiment, bubbles b also may be produced by supplying air from the air supply pipe 7 into the plating solution in order to expedite the eutectoid of fine particles. The air supply is started simultaneously with the decrease of the flow velocity. When the bubbles b are produced in the plating solution flowing at a flow velocity of approximately 15 cm/s, they move upward while putting aside fine particles therearound, and the fine particles pushed aside come closer to the cylinder inner surface, by which the eutectoid effect is enhanced.

As a result, the eutectoid of mores mount of silicon carbide (SiC) can be achieved by the fine particle eutectoid expedition effect obtained by decreasing the flow velocity, the process speed increase effect obtained by increasing the current density, and the fine particles eutectoid effect obtained by producing the bubbles b.

As described above, in the composite plating method of the second embodiment, since the flow velocity of the plating solution is set at a high value at the beginning of inflow of the plating solution and is decreased after a lapse of a predetermined time, adhesion to the base metal can be enhanced and the eutectoid amount of fine particles on the side of the surface of the plating layer can be increased. The eutectoid amount can be further increased by mixing bubbles into the composite plating solution. Still furthermore, the plating time can be shortened by increasing the current density almost simultaneously with the decrease of the flow velocity.

What is claimed is:

1. A method for providing a composite plating on an inner peripheral wall defining a space having a cylindrical portion in a hollow member, comprising:

inserting an insertion electrode into the cylindrical portion of the space so as to be spaced from the inner peripheral wall;

circulating a composite plating solution from a solution supply pipe into the cylindrical portion of the space and around the insertion electrode at a first flow velocity;

connecting a base metal electrode to the hollow member;

establishing a current between the insertion electrode and the hollow member to form a composite plating on the cylindrical portion of the inner peripheral wall; and while the current is established between the insertion electrode and the hollow member, decreasing the flow velocity of the composite plating solution after lapse of a predetermined time.

2. The method of claim 1, further comprising supplying a gas to the composite plating solution to produce bubbles in the plating solution when the flow velocity of the composite plating solution is decreased.

3. The method of claim 2, further comprising increasing the current density between the insertion electrode and the hollow member when the flow velocity of the composite plating solution is decreased.

4. The method of claim 1, further comprising increasing the current density between the insertion electrode and the hollow member when the flow velocity of the composite plating solution is decreased.

5. The method of claim 1, wherein the composite plating solution comprises metal ions and fine particles which form a eutectoid plating of metal and fine particles, the amount of fine particles in the eutectoid plating increasing when the flow velocity of the composite solution is decreased, whereby an initial plating layer composed mainly of a metal phase is formed on the inner peripheral surface before the flow velocity of the composite plating solution is decreased.

6. The method of claim 5, wherein the fine particles are silicon carbide.

7. The method of claim 6, wherein the metal is nickel.

* * * * *

UNITED STATES PATENT AND TRADEMARK OFFICE
CERTIFICATE OF CORRECTION

PATENT NO. : 5,540,829

DATED : July 30, 1996

INVENTOR(S) : Mase et al.

It is certified that error appears in the above-identified patent and that said Letters Patent is hereby corrected as shown below:

In column 1, line 18, "Silicon" should be --silicon--;

line 26, "butting" should be --putting--.

In column 3, line 54, "a" should be --4--.

In column 4, line 5, "Mount" should be --amount--;

line 9, "An" should be --in--;

line 9, "basks" should be --basis--;

line 25, "As" should be --is--.

In column 5, line 48, "mores mount" should be --more amount--.

Signed and Sealed this

Eleventh Day of March, 1997

*Attest:*

Bruce Lehman

BRUCE LEHMAN

*Attesting Officer*

*Commissioner of Patents and Trademarks*